US010618158B2

(12) United States Patent
Liu

(10) Patent No.: US 10,618,158 B2
(45) Date of Patent: Apr. 14, 2020

(54) AUXILIARY HANDLE FOR HEX WRENCHES

(71) Applicant: Ningbo King Mount Co., Ltd., Ningbo, Zhejiang (CN)

(72) Inventor: Yifeng Liu, Zhejiang (CN)

(73) Assignee: Ningbo King Mount Co., Ltd., Ningbo (CN)

( * ) Notice: Subject to any disclaimer, the term of this patent is extended or adjusted under 35 U.S.C. 154(b) by 174 days.

(21) Appl. No.: 16/009,869

(22) Filed: Jun. 15, 2018

(65) Prior Publication Data

US 2019/0381650 A1 Dec. 19, 2019

(51) Int. Cl.
*B25G 1/00* (2006.01)
*B25B 23/16* (2006.01)
*B25B 15/00* (2006.01)

(52) U.S. Cl.
CPC ..... *B25G 1/005* (2013.01); *B25B 23/16* (2013.01); *B25B 15/008* (2013.01)

(58) Field of Classification Search
CPC ..... B25G 1/005; B25B 23/16; B25B 15/008
See application file for complete search history.

(56) References Cited

U.S. PATENT DOCUMENTS 2,715,028 A * 8/1955 Dossie ..... B25B 13/56 81/177.4
5,911,799 A * 6/1999 Johnson ..... B25B 13/56 81/177.2
6,209,425 B1 * 4/2001 Hu ..... B25B 15/008 81/177.1
6,311,587 B1 * 11/2001 Johnson ..... B25B 13/56 81/177.1
6,332,381 B1 * 12/2001 Vasudeva ..... B25B 15/008 81/177.1
6,490,954 B2 * 12/2002 Johnson ..... B25B 13/56 81/177.2
6,510,766 B1 * 1/2003 Lin ..... B25B 15/008 81/177.4
6,675,678 B2 * 1/2004 Liu ..... B25G 1/005 81/177.2
6,763,744 B2 * 7/2004 Johnson ..... B25B 13/56 81/177.2
6,941,843 B2 * 9/2005 Johnson ..... B25B 13/56 81/177.2
7,788,996 B2 * 9/2010 Johnson ..... B25B 13/56 81/177.1
7,946,203 B2 * 5/2011 Johnson ..... B25B 15/008 81/439
9,193,058 B2 * 11/2015 Gallegos ..... B25G 3/24
9,387,579 B2 * 7/2016 Johnson ..... B25G 1/06
(Continued)

*Primary Examiner* — David B. Thomas

(57) ABSTRACT

An auxiliary handle for hex wrenches includes a housing, a stem and a knob. The stem is mounted in the housing and is fixedly connected with the knob. The entire outer circumferential surface of the stem is provided with a plurality of mounting slots of different sizes along the axial direction of the stem. The right end wall surface of the housing is provided with a notch that can be connected to the mounting slots. The inner wall of the left end of the housing is correspondingly provided with a flat spring. The knob is rotatable to drive the stem to rotate around the axial direction in the housing so that one of the mounting slots connects to the notch and is opposite to the flat spring.

7 Claims, 7 Drawing Sheets

(56) References Cited

U.S. PATENT DOCUMENTS

| | | | | |
|---|---|---|---|---|
| 9,463,568 | B2 * | 10/2016 | Chen | B25G 1/063 |
| 9,969,076 | B2 * | 5/2018 | Tsai | B25G 1/085 |
| 10,322,503 | B2 * | 6/2019 | Johnson | B25B 15/008 |
| 2003/0110906 | A1 * | 6/2003 | Li | B25B 15/008 81/177.1 |
| 2003/0136234 | A1 * | 7/2003 | Cunningham | B25B 15/008 81/177.4 |
| 2016/0207189 | A1 * | 7/2016 | Chen | B25G 1/063 |
| 2016/0279785 | A1 * | 9/2016 | Johnson | B25G 1/06 |

* cited by examiner

AUXILIARY HANDLE FOR HEX WRENCHES

FIELD OF TECHNOLOGY

The present application relates to an auxiliary handle, in particular to an auxiliary handle for hex wrenches.

BACKGROUND TECHNOLOGY

An Allen wrench is a tool frequently used in the mechanical industry. The Allen wrench exerts a force on a bolt through torque. Since the size of an Allen wrench cannot be adjusted, a set of Allen wrenches of various sizes is often used. The current Allen wrench is mostly one end serving as a working end and one end serving as a handle. Due to the small size, it is inconvenient for a worker to grasp the handle end.

Current auxiliary handle is designed for installation and removal. The handle utilizes lever principle to achieve an effortless driving of the handle end of an Allen wrench. The auxiliary handle is usually provided with a handle portion having a clamp at one end or both ends thereof for clamping the handle of an Allen wrench. When an external force is applied to the handle portion in the direction of rotation of threads, the auxiliary handle can screw a bolt. However, in the prior art, the auxiliary handle size setting is very limited to an Allen wrench and is not flexible for use in various models.

Therefore, how to design a hex wrench auxiliary handle with a simple structure, good applicability, and convenience for use has become a direction of thinking for designers of the present application.

In view of this, the designer of the present application has conducted in-depth discussions on the foregoing problems, and, with years of experience in R&D and manufacturing of related industries, has been actively seeking solutions. After long-term efforts in research and development, the present application of "auxiliary handle for hex wrenches" has been successfully developed to resolve the problems of the prior art.

SUMMARY

The technical problem to be solved by the present application is to provide an auxiliary handle for hex wrenches, which is provided with a plurality of mounting slots of different sizes to accommodate hex wrenches of different sizes, and is provided with a flat spring to finely adjust to the sizes of the mounting slots in order to adapt to the installation of a hex wrench and to ensure that the hex wrench does not come off easily and does not wobble.

The technical solution adopted by the present application to solve the above technical problems is: an auxiliary handle for hex wrenches, which includes a housing, a stem and a knob. The stem is mounted in the housing and is fixedly connected with the knob. The entire outer circumferential surface of the stem is provided with a plurality of mounting slots of different sizes along the axial direction of the stem. The right end wall surface of the housing is provided with a notch that can be connected to the mounting slots. The inner wall of the left end of the housing is correspondingly provided with a flat spring. The knob is rotatable to drive the stem to rotate around the axial direction in the housing so that one of the mounting slots connects to the notch and is opposite to the flat spring.

A further preferred solution of the present application: the flat spring has a strip-shaped sheet structure. The surface of the flat spring is provided with a plurality of upwardly protruding spring claws located on a line.

A further preferred solution of the present application: the inner wall of the housing is provided with a groove, and the flat spring is mounted in the groove. The spring claws protrude from the inner wall surface of the housing.

A further preferred solution of the present application: the housing has a cylindrical structure. The knob is provided on the right side of the housing.

A further preferred solution of the present application: a spring slot is provided on the right end outer wall of the stem. The spring slot is mounted therein a spring and connects a steel ball through the spring. The right end inner wall of the housing is provided with a plurality of clamping slots. The location of the clamping slots is in one-to-one correspondence with the location of the mounting slots.

A further preferred solution of the present application: the surface of the knob is labelled with different size marks which correspond to different sizes of the mounting slots.

A further preferred solution of the present application: the stem is rotatably mounted within the housing though a bolt.

Compared with the prior art, the advantages of the present application lie on that the stem is mounted in the housing and is fixedly connected with the knob, and the entire outer circumferential surface of the stem is provided with a plurality of mounting slots of different sizes along the axial direction of the stem. The plurality of mounting slots of different sizes is provided to accommodate different sizes of hex wrenches. The right end wall surface of the housing is provided with a notch that can be connected to the mounting slots. The hex wrench is inserted through the notch into the hexagonal slot formed by the mounting slot and the inner wall of the housing. The inner wall of the left end of the housing is correspondingly provided with a flat spring. The knob is rotatable to drive the stem to rotate around the axial direction in the housing so that one of the mounting slots connects to the notch and is opposite to the flat spring. The flat spring is located on the left side of the notch, and the flat spring and the notch are in a straight line. In other words, the hex wrench inserted through the notch into the mounting slot is bound to be affected by the flat spring. The flat spring will come into contact with the bottom surface of the hex wrench and apply an elastic force to the hex wrench so that the wrench will not come off and wobble after installation. Due to the elasticity of the flat spring, the size of the mounting slots can be adjusted. Therefore, one mounting slot can accommodate a certain range of hex wrenches of different specifications.

BRIEF DESCRIPTIONS OF THE DRAWINGS

DETAILED DESCRIPTIONS

The present application will be described in detail below with reference to the accompanying drawings.

In order to make the objectives, technical solutions, and advantages of the present application clearer and more comprehensible, the present application will be further described in detail below with reference to the accompanying drawings and embodiments. It should be understood that the specific embodiments described herein are only used to explain the present application and are not used to limit the present application.

Figure 1:
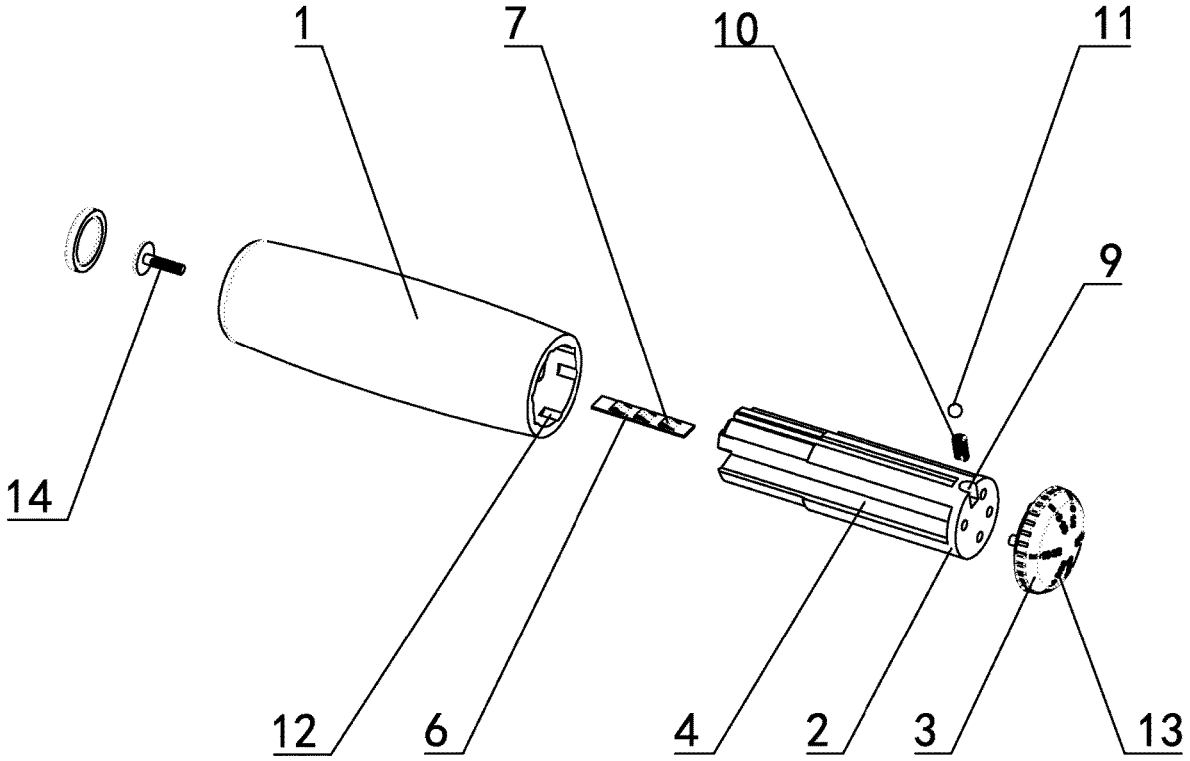
FIG. 1 is a schematic exploded view of the present application.
Figure 2:
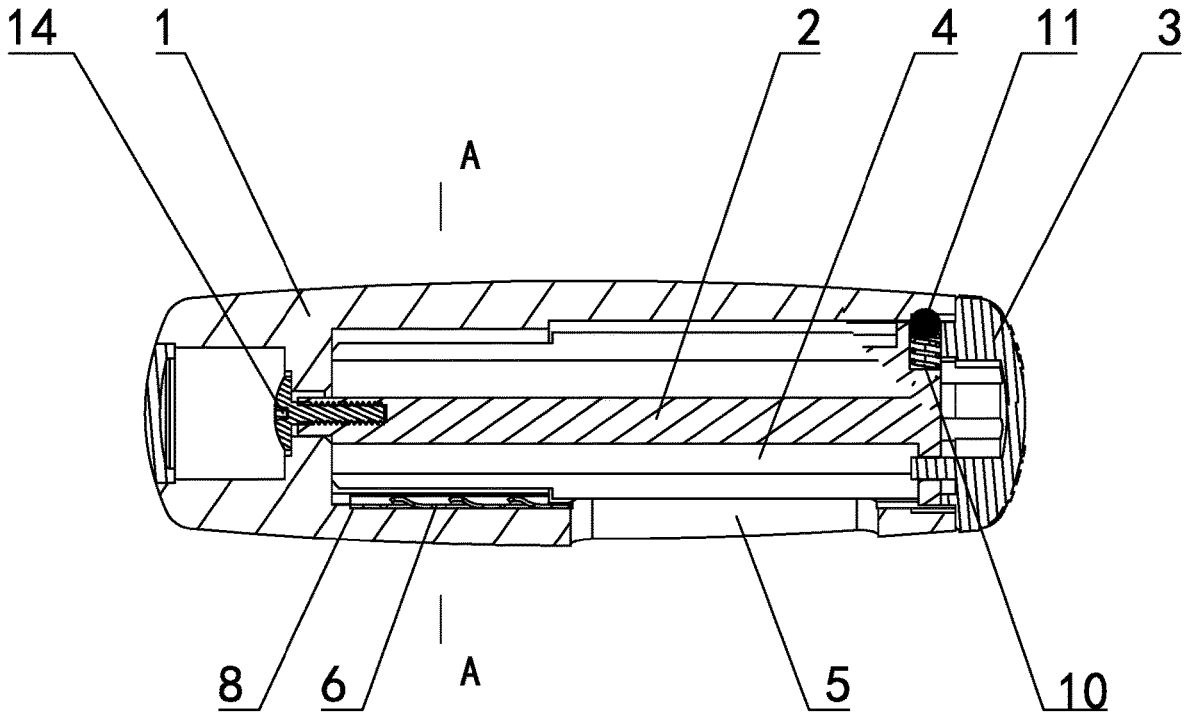
FIG. 2 is a first schematic diagram of the present application.
Figure 3:
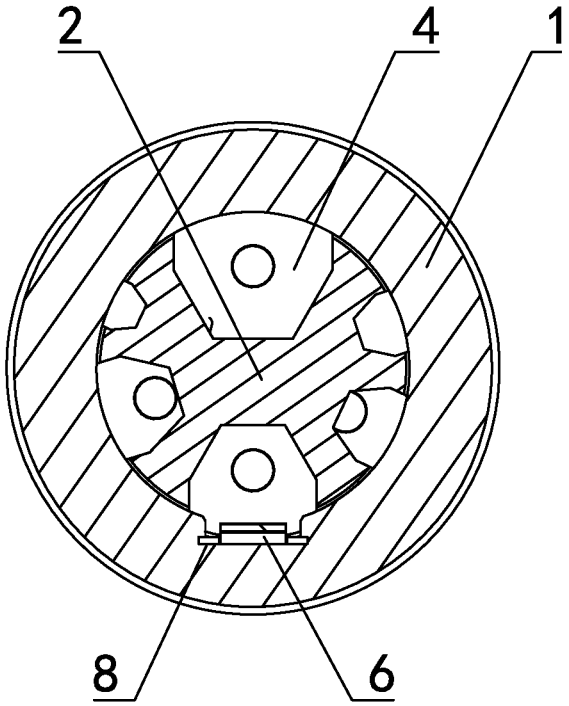
FIG. 3 is a sectional view of AA section of FIG. 2.
Figure 4:
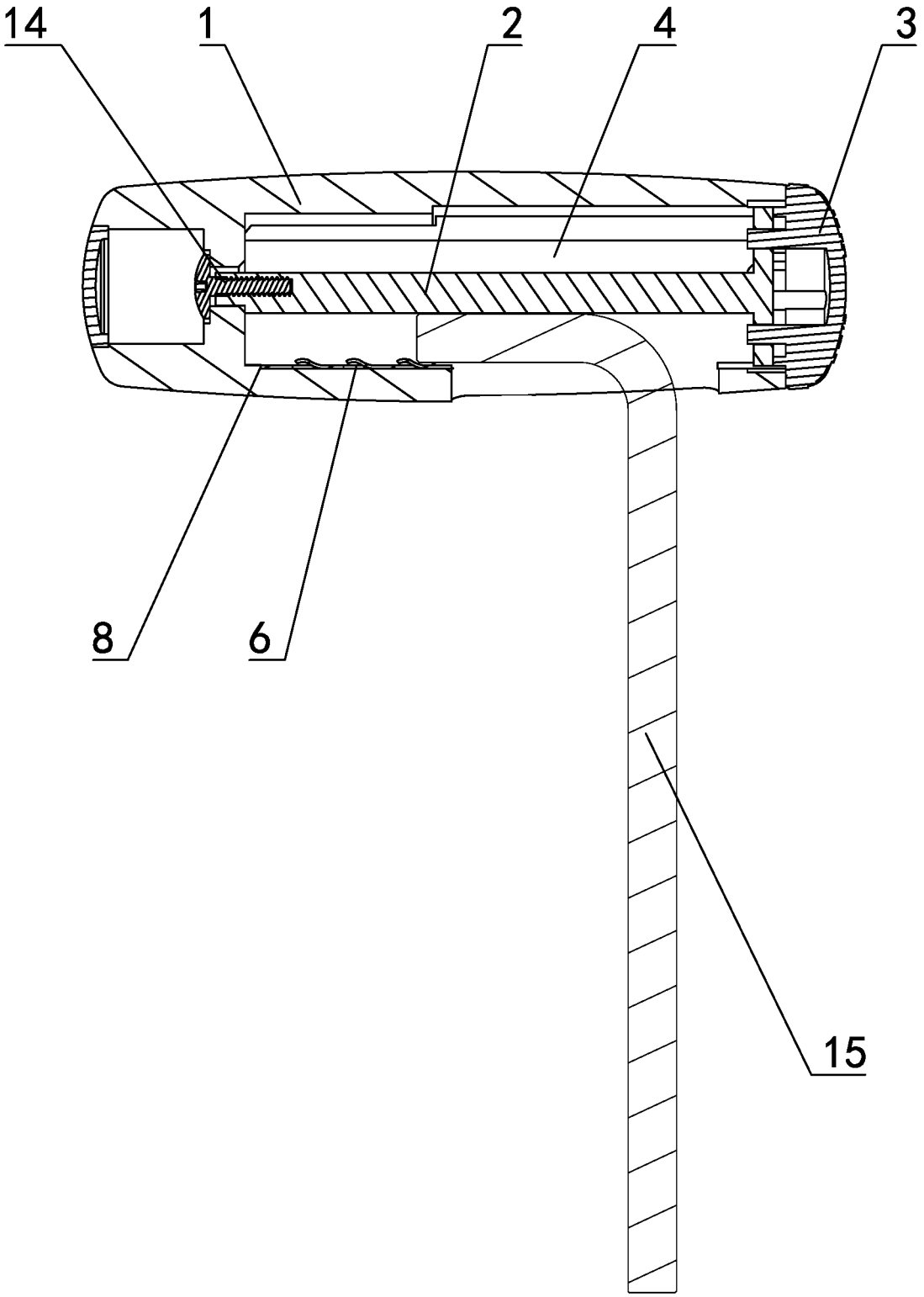
FIG. 4 is a schematic structural view of the present application during installation.
Figure 5:
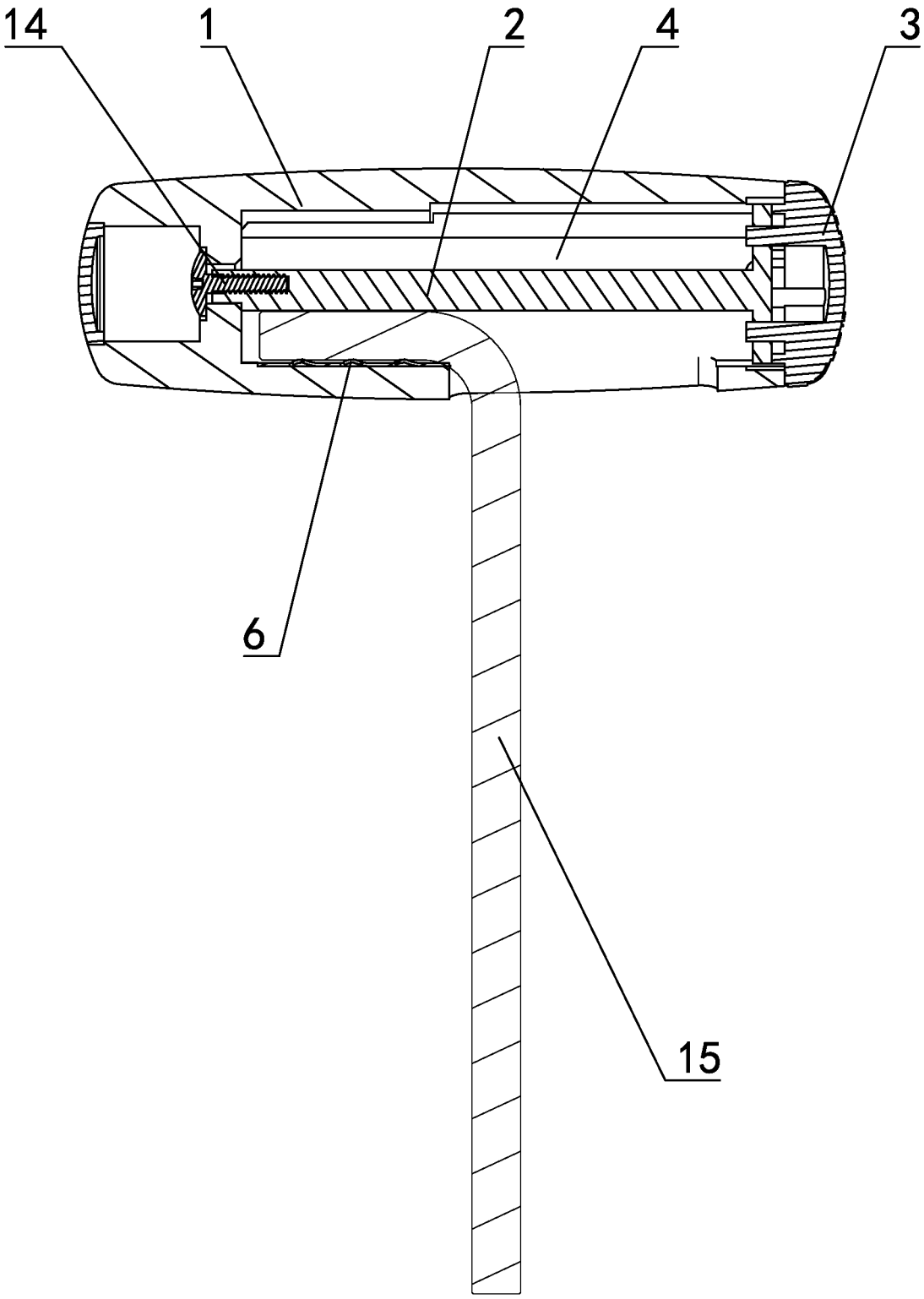
FIG. 5 is a schematic structural view of the present application after installation.
Figure 6:
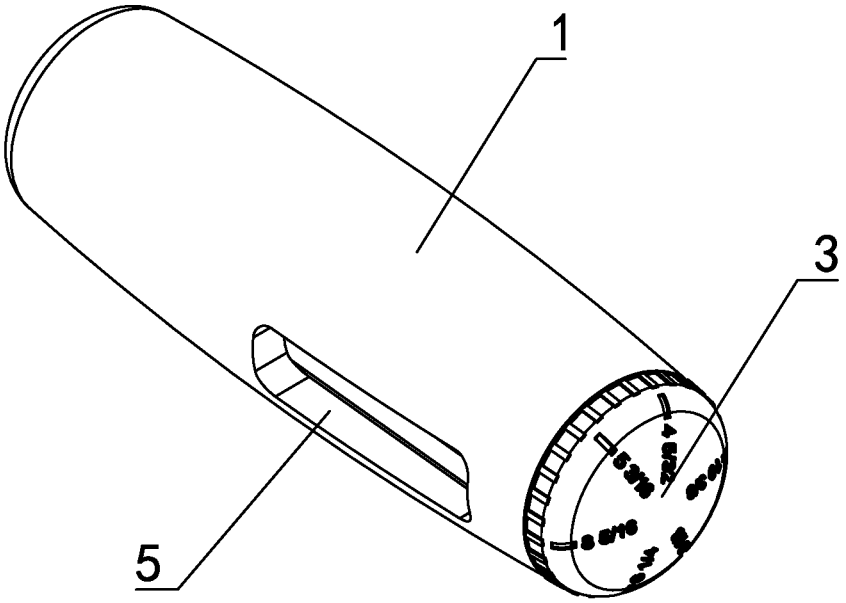
FIG. 6 is a second schematic diagram of the structure of the present application.
Figure 7:
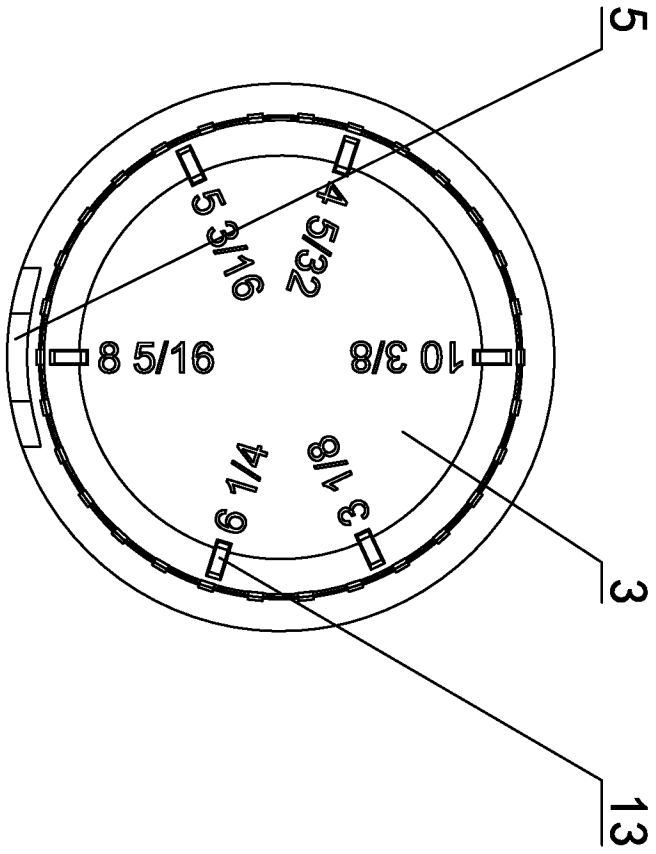
FIG. 7 is a side view of the present application.

As shown in FIGS. 1 to 7, an auxiliary handle for hex wrenches includes a housing 1, a stem 2 and a knob 3. The stem 2 is mounted in the housing 1 and is fixedly connected with the knob 3. The entire outer circumferential surface of the stem 2 is provided with a plurality of mounting slots 4 of different sizes along the axial direction of the stem. The right end wall surface of the housing 1 is provided with a notch 5 that can be connected to the mounting slots 4. The inner wall of the left end of the housing 1 is correspondingly provided with a flat spring 6. The knob 3 is rotatable to drive the stem 2 to rotate around the axial direction in the housing 1 so that one of the mounting slots 4 connects to the notch 5 and is opposite to the flat spring 6.

The flat spring 6 has a strip-shaped sheet structure. The surface of the flat spring 6 is provided with a plurality of upwardly protruding spring claws 7 located on a line. After the spring claws 7 are tilted, a 1 mm-distance can be used for adjusting to the size of the mounting slots 4 and can stabilize installation of a hex wrench 15.

The inner wall of the housing 1 is provided with a groove 8, and the flat spring 6 is mounted in the groove 8. The spring claws 7 protrude from the inner wall surface of the housing 1.

The housing 1 has a cylindrical structure. The knob 3 is provided on the right side of the housing 1. The cylindrical structure of the housing 1 is a relatively reasonable structural design and can accommodate the stem 2.

A spring slot 9 is provided on the right end outer wall of the stem 2. The spring slot 9 is mounted therein a spring 10 and connects a steel ball 11 through the spring 10. The right end inner wall of the housing 1 is provided with a plurality of clamping slots 12. The location of the clamping slots 12 is in one-to-one correspondence with the location of the mounting slots 4. The steel ball 11 in coordination with the spring slot 9 for position limit of rotation of the stem 2 is provided. If position limit is not provided and the knob 3 is allowed to arbitrarily rotate and adjust, it is difficult to align a mounting slot 4 with the notch 5, resulting in difficulty in installing the hex wrench 15. Once a locking member is provided, a user can simply adjust to the desired mounting position of each mounting slot 4.

The surface of the knob 3 is labelled with different size marks 13 which correspond to different sizes of the mounting slots 4. The size marks 13 are provided so that the user can intuitively adjust to the mounting slot 4 of the required size.

The stem 2 is rotatably mounted within the housing 1 though a bolt 14.

The hex wrench 15 according to the present application has an L-shaped structure, which aims to solve the problems of insufficient torque on the short side of the hex wrench 15 and poor user experience when using the long side of the hex wrench 15. The auxiliary handle designed of the present application provides a good solution to this problem. The present application uses the mounting slots 4 of the stem 2 and the housing 1 to form a plurality of closed hexagonal slots. A flat spring 6 (a spring element) is provided in the slots so that the hex wrench 15 inserted into the slots will be subjected to the elastic force of the flat spring 6, and the hex wrench 15 will not wobble after installation.

The stem 2 rotates around the housing 1. Due to the locking effect of the steel ball 11 and the spring slot 9, the stem 2 forms a hole with sizes of different specifications and models at the notch 5 of the housing 1. These sizes correspond to the corresponding sizes of the hex wrench 15, thereby forming a handle in coordination with multiple hex wrenches 15 and achieving the effect of assisting the hex wrench 15.

The foregoing descriptions are merely preferred embodiments of the present application and are not intended to limit the present application. Any modification, equivalent replacement and improvement made within the spirit and principle of the present application shall be included in the scope of protection of the present application.

What is claimed is:

1. An auxiliary handle for hex wrenches, the auxiliary handle comprising a housing, a stem and a knob, wherein the stem is mounted in the housing and is fixedly connected with the knob; an entire outer circumferential surface of the stem is provided with a plurality of mounting slots of different sizes along an axial direction of the stem; a right end wall surface of the housing is provided with a notch that can be connected to the mounting slots; an inner wall of a left end of the housing is correspondingly provided with a flat spring; and the knob is rotatable to drive the stem to rotate around the axial direction in the housing so that one of the mounting slots connects to the notch and is opposite to the flat spring.

2. The auxiliary handle for hex wrenches of claim 1, wherein the flat spring has a strip-shaped sheet structure; and a surface of the flat spring is provided with a plurality of upwardly protruding spring claws located on a line.

3. The auxiliary handle for hex wrenches of claim 2, wherein the inner wall of the housing is provided with a groove; the flat spring is mounted in the groove; and the spring claws protrude from an inner wall surface of the housing.

4. The auxiliary handle for hex wrenches of claim 1, wherein the housing has a cylindrical structure and the knob is provided on a right side of the housing.

5. The auxiliary handle for hex wrenches of claim 1, wherein a spring slot is provided on a right end outer wall of the stem; the spring slot is mounted therein a spring and connects a steel ball through the spring; a right end inner wall of the housing is provided with a plurality of clamping slots; and location of the clamping slots is in one-to-one correspondence with location of the mounting slots.

6. The auxiliary handle for hex wrenches of claim 1, wherein surface of the knob is labelled with different size marks which correspond to different sizes of the mounting slots.

7. The auxiliary handle for hex wrenches of claim 1, wherein the stem is rotatably mounted within the housing though a bolt.

* * * * *